US008740129B2

(12) United States Patent
Keily et al.

(10) Patent No.: US 8,740,129 B2
(45) Date of Patent: Jun. 3, 2014

(54) HANDLE OPERATED SWITCH FOR PAPER TOWEL DISPENSER

(75) Inventors: Joel P. Keily, Corona, CA (US); Charles Parkin Davis, Torrance, CA (US); Lockland Corley, Coquitlam (CA); Richard Lalau, North Vancouver (CA)

(73) Assignee: Dispensing Dynamics International, City of Industry, CA (US)

( * ) Notice: Subject to any disclaimer, the term of this patent is extended or adjusted under 35 U.S.C. 154(b) by 313 days.

(21) Appl. No.: 13/317,492

(22) Filed: Oct. 19, 2011

(65) Prior Publication Data

US 2013/0026019 A1 Jan. 31, 2013

Related U.S. Application Data

(60) Provisional application No. 61/455,505, filed on Oct. 21, 2010.

(51) Int. Cl.
*B65H 26/00* (2006.01)

(52) U.S. Cl.
USPC ..... 242/563; 242/564.1; 242/565

(58) Field of Classification Search
USPC ..... 242/563, 563.1, 564, 564.1, 564.3, 242/564.4, 564.5, 565
See application file for complete search history.

(56) References Cited

U.S. PATENT DOCUMENTS

| | | | | |
|---|---|---|---|---|
| 3,876,163 | A * | 4/1975 | Kobrehel | 242/382.1 |
| 6,446,901 | B1 * | 9/2002 | Haen et al. | 242/564.1 |
| 2008/0217350 | A1 * | 9/2008 | Hansen et al. | 221/15 |
| 2009/0140001 | A1 * | 6/2009 | Lewis et al. | 221/13 |
| 2010/0102101 | A1 * | 4/2010 | Keily et al. | 242/564.1 |

OTHER PUBLICATIONS

U.S. Appl. No. 12/455,121, filed May 27, 2009.

* cited by examiner

*Primary Examiner* — Sang Kim
*Assistant Examiner* — Nathaniel Adams
(74) *Attorney, Agent, or Firm* — Thomas R. Lampe

(57) ABSTRACT

Control apparatus for controlling operation of a paper towel dispenser includes control switches and a handle having two relatively movable handle portions rotating when a paper toweling support drum rotates. One of the handle portions has projections which engage the switches when the handle rotates.

9 Claims, 4 Drawing Sheets

HANDLE OPERATED SWITCH FOR PAPER TOWEL DISPENSER

This application is based on and claims the benefit of the filing date of U.S. Provisional Patent Application No. 61/455,505, filed Oct. 21, 2010.

TECHNICAL FIELD

This invention relates to paper towel dispensing and more particularly to control switch mechanism employed in an electrically operated paper towel dispenser.

BACKGROUND OF THE INVENTION

Co-pending U.S. patent application Ser. No. 12/455,121, filed May 27, 2009, discloses a multi-function paper towel dispenser selectively operable to dispense paper toweling from a roll of paper toweling employing a plurality of alternative operational modes. The desired mode of operation can be selected utilizing mode control switches associated with sensor structure and electronic control circuitry of the dispenser. Two of the modes are a paper hidden mode and a paper exposed mode, each of which utilizes sensor structure in combination with electronic control circuitry to operate an electric motor driven rotatable toweling support roller to partially cut and dispense the paper toweling. The electric motor is also utilized to rotate the paper toweling support roller when not employing the sensor structure, the motor essentially operating in a hybrid mode wherein a pull force exerted on the toweling tail initiates rotation of the toweling support roller, the electric motor then being energized to reduce the pull force required by a user to effect final dispensing of a towel. Furthermore, a user can manually rotate the paper toweling support roller to effect dispensing of a towel in any of the modes.

The sensor structure of the multi-function or multi-mode paper towel dispenser is operatively associated with the electric motor to energize the electric motor and cause rotation of the toweling support roller to transport the paper toweling for dispensing from the dispenser in either a first mode of operation wherein the electric motor is energized responsive to the sensor structure sensing positioning of a user's hand at a predetermined location external of the housing or in a second mode of operation wherein the electric motor is energized responsive to the sensor structure sensing the removal of a toweling tail from a location external of the housing.

The dispenser disclosed in U.S. patent application Ser. No. 12/455,121 incorporates manually actuated slidable mode control switches employed to change between the modes of operation as well as mechanical control switching operatively associated with the toweling support roller and which is actuated during rotation of the toweling support roller to energize and de-energize the electric motor driving the toweling support roller as appropriate for a selected mode of operation.

More particularly, a mechanical electric switch is employed which includes a switch actuator element biased into contact with a cam-like interior surface of an end of the towel support roller.

DISCLOSURE OF THE INVENTION

The present invention is not only applicable as an alternative to the mechanical electrical switch system disclosed and utilized in the multi-mode paper towel dispenser of the pending application discussed above, but also may be utilized in connection with paper towel dispensers of other types to control a motor utilized to drive a toweling support roller or control other operations or functions of the dispenser.

The control apparatus of this invention is for controlling operation of a paper towel dispenser including a rotatable paper toweling support drum. The control apparatus includes at least one control switch spaced from said rotatable paper toweling support drum and a handle operatively connected to said paper toweling support drum and rotatable responsive to rotation of said paper toweling support drum. The handle during rotation thereof alternatively opens and closes the at least one control switch to control a function of said paper towel dispenser.

The handle is operatively connected to a shaft associated with said paper toweling support drum and rotatable during rotation of said toweling support drum.

BEST MODE FOR CARRYING OUT THE INVENTION

Figure 1:
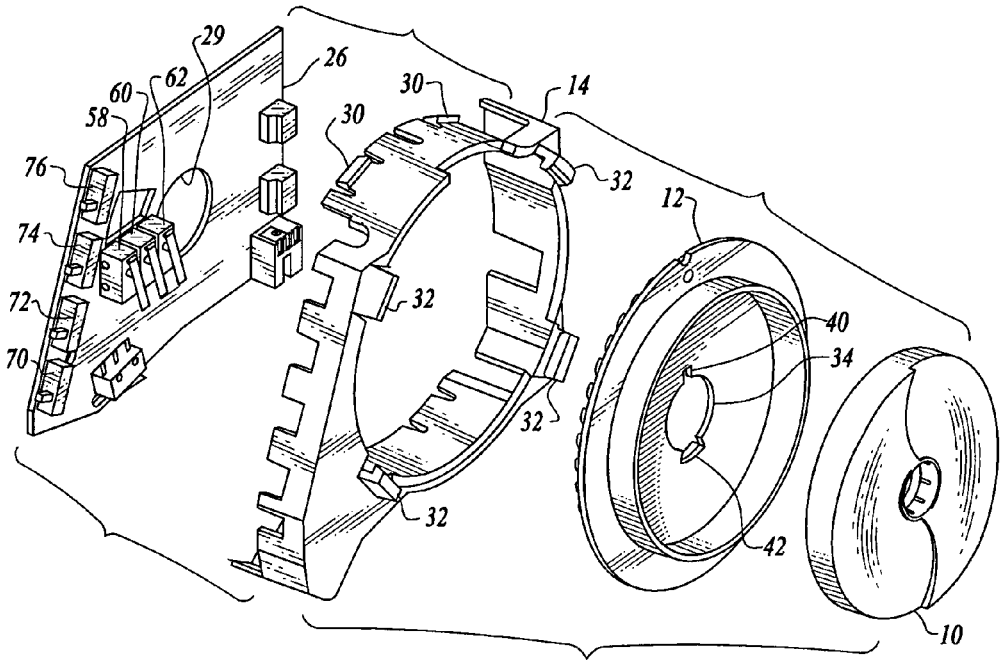
FIG. 1 is an exploded, perspective view illustrating selected components of apparatus constructed in accordance with the teachings of the present invention, including a first handle portion, a second handle portion, a handle retainer and an electronic control board.
Figure 2:
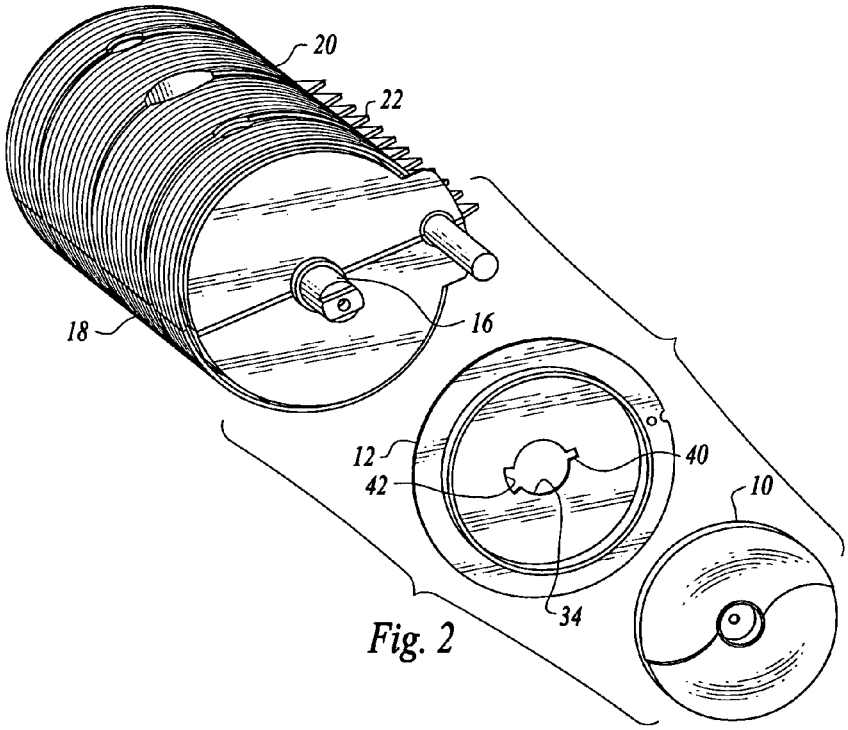
FIG. 2 is an exploded, perspective view illustrating the first and second handle portions in relationship with a paper towel dispenser drum assembly.
Figure 3:
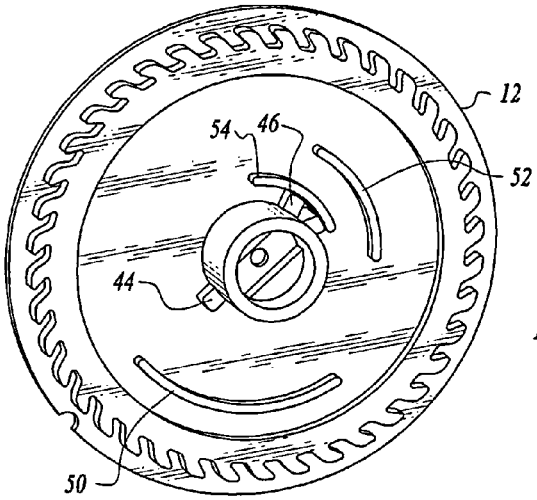
FIG. 3 is an enlarged, perspective view illustrating the back or inner side of the second handle portion when connected to the first handle portion and three ribs attached to the inner surface thereof and projecting from the inner surface.

Referring now to the drawings, the illustrated preferred embodiment of the invention includes an outer handle portion 10, an inner handle portion 12 and a handle retainer 14. The outer handle portion 10 is directly connected to the drum axle or shaft 16 of toweling support drum 18 of drum assembly 20, a cutter blade 22 being associated with the toweling support drum.

An electric motor 24 controlled by electronic control board 26 rotates the drum via gears 27, 28 to transport and cut toweling. It will be noted that the electronic control board 26 defines an aperture 29 through which the drum axle 16 passes. Handle retainer 14 is adjacent to electronic control board 26 and is attached by any known expedient such as snap lugs 30 to the chassis or housing (not shown) of the paper towel dispenser.

Inner handle portion 12 is positioned within a recess of handle retainer 14 and is rotatable relative thereto. The inner handle portion 12 floats axially under snap hooks 32 of the handle retainer. The drum axle 16 passes through a central aperture 34 formed in inner handle portion 12. Outer handle portion 10, which as previously indicated is fixedly attached to drum axle 16, is disposed in a recess formed at the outer side of inner handle portion 12.

Figure 4:
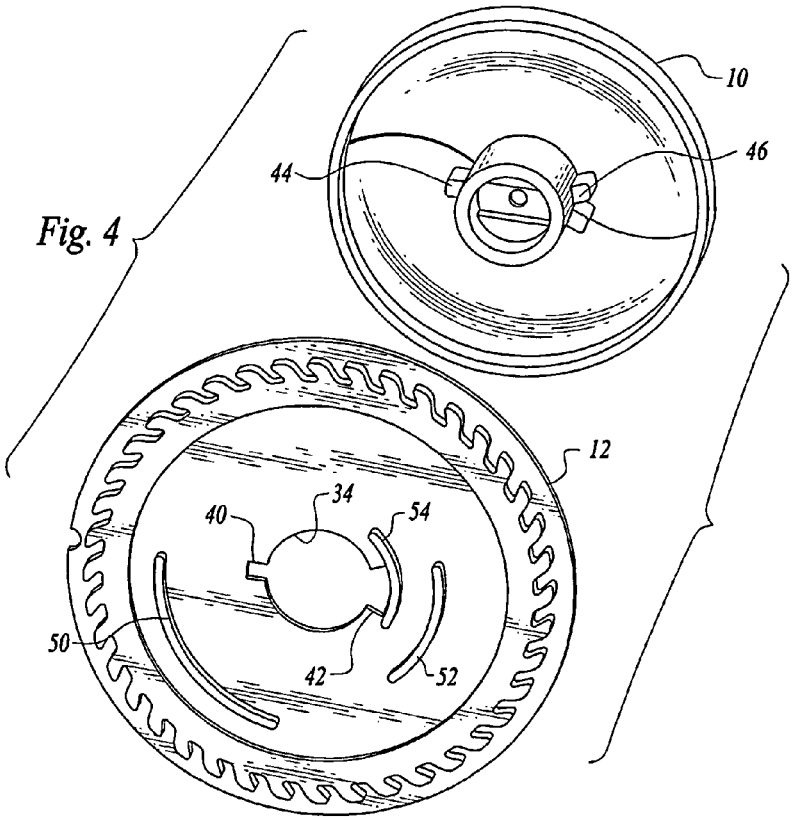
FIG. 4 is an exploded, perspective view illustrating the back or inner sides of the first and second handle portions.
Figure 5:
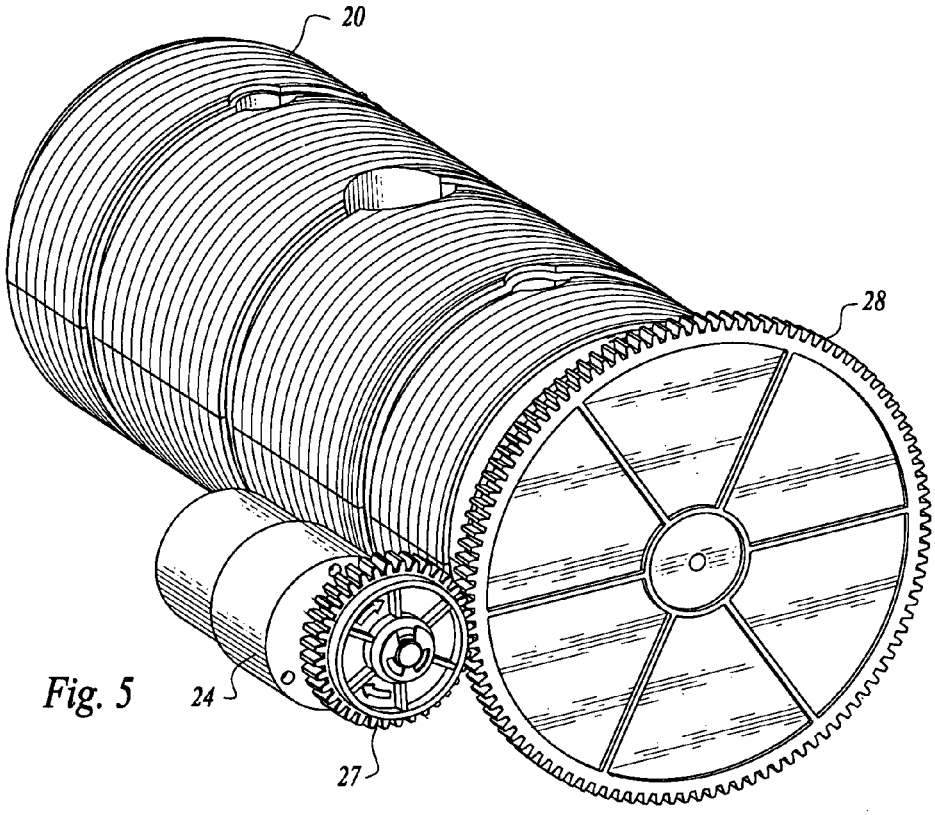
FIG. 5 is an enlarged, perspective view illustrating a drum assembly of the towel dispenser, an electric drive motor and gears interconnecting the motor to the drum assembly.

Aperture 34 includes a narrow keyway 40 and a wide keyway 42. These keyways respectively receive single key 44 of the outer handle portion 10 and double key 46 of the outer handle portion shown in FIG. 4 for example. Thus, relative rotation between the inner and outer handle portions is prevented while axial movement of inner handle portion 12 relative to outer handle portion 10 and the drum axle can take place.

Figure 6:
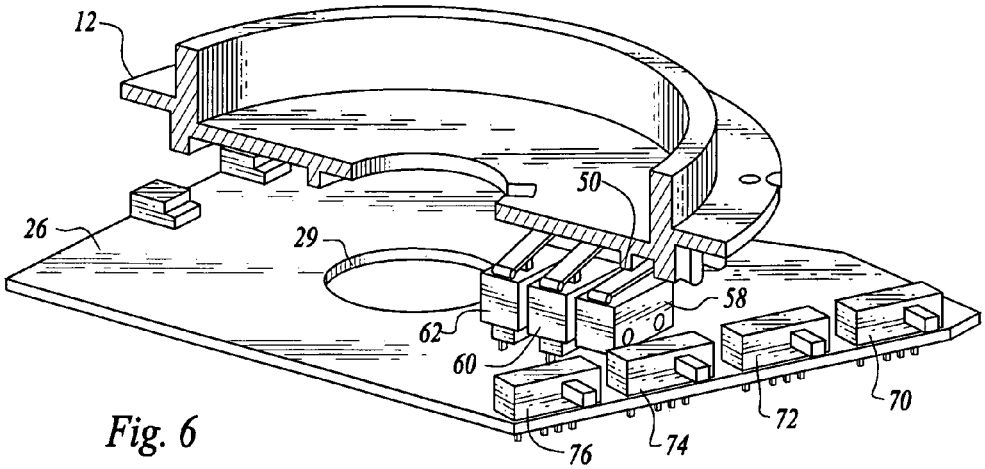
FIG. 6 is an enlarged, perspective view in partial cross-section illustrating the inner or second handle portion in operative position relative to the electronic control board and more specifically relative to switches thereof engageable by ribs on the second handle portion.
Figure 8:
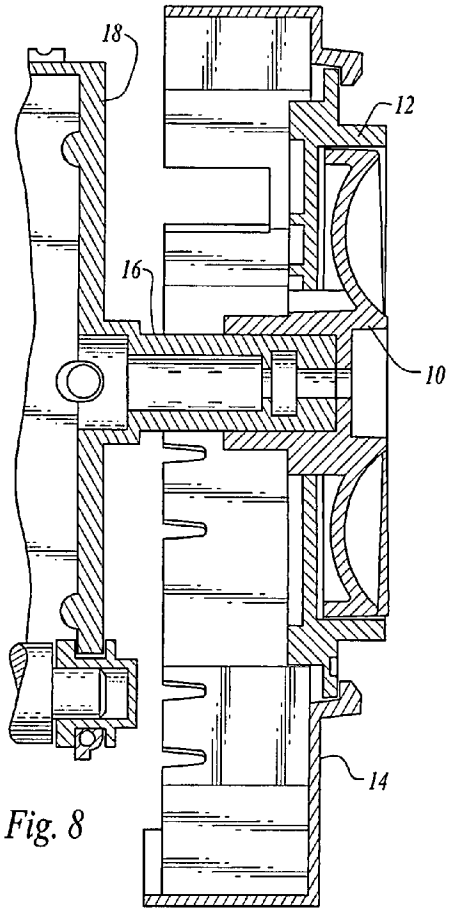
FIG. 8 is a top, plan view in partial cross-section of the interconnected drum assembly and first and second handle portions.
Figure 7:
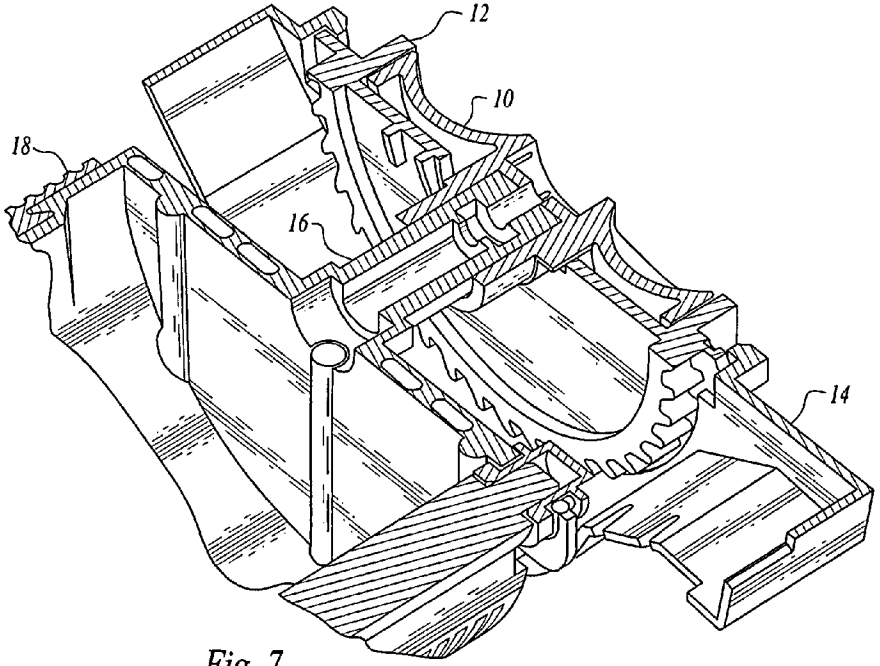
FIG. 7 is an enlarged, perspective view in partial cross-section illustrating the interconnection existing between the drum assembly and the first and second handle portions when connected together.

Projecting from the inner surface of inner handle portion 12 are three arcuate ribs 50, 52, 54. These ribs are of different lengths and are positioned different distances from the center of the inner handle portion. During rotation of inner handle portion 12 by virtue of its interconnection with outer handle portion 10, these ribs will be brought into engagement with switches 58, 60, 62 located on electronic control board 26. Engagement between the ribs and the switches will cause the switches to close, FIG. 6, for example, showing rib 50 in engagement with switch 58 and closing switch 58. It will be appreciated that the lengths of the ribs will determine how long each switch is depressed. The times and durations of switch closure during each operational cycle will depend upon the lengths of the ribs and where the ribs are located on the inner surface of the inner handle portion.

These switches may be utilized to control the times and duration of different functions of the dispenser with which they are associated. For example, in the embodiment illustrated, switches 58, 60 and 62 are part of an electric circuit which controls multi-mode operation of the dispenser. The ribs located at the inner surface of inner handle portion 12 can actuate switches on control board 26 to control start/stop points for selected modes of operation as well as other dispenser functions.

In the illustrated embodiment, switches 70, 72, 74 and 76 of the electronic control board are utilized in the dispenser and are respectively a mode selector switch 70, a delay mode selector switch 72, a delayed time selector switch 74, and a sensitivity selector switch 76.

If inner handle portion 12 were directly connected to the drum assembly rather than floating axially while rotating with outer handle portion 10 by means of the keyway interconnection, more expensive manufacturing techniques would be required to maintain the proper clearance and actuation of the switches. For example, a warped drum axle could create a condition where a switch is not depressed at the proper time or the switch is depressed too far, causing it to break.

It will be appreciated that the handle comprising handle portions 10 and 12 is suitably positioned outside the cabinet of the dispenser so that it can be employed to manually rotate the toweling support drum if desired.

The invention claimed is:

1. Control apparatus for controlling operation of a paper toweling dispenser including a rotatable double-ended paper toweling support drum, a shaft projecting from at least one of the ends of said paper toweling support drum and an electric motor for simultaneously rotating said paper toweling support drum and said shaft, said control apparatus including, in combination:

at least one control switch;

a handle connected to said shaft and rotatable responsive to rotation of said paper toweling support drum and said shaft, said handle during rotation thereof alternatively opening and closing said at least one control switch to control a function of said paper towel dispenser, said handle including an outer handle portion and an inner handle portion, said outer handle portion fixedly attached to said shaft and rotatable with said shaft, and said inner handle portion slidably attached to said shaft and defining an opening receiving said shaft, said inner handle portion axially movable relative to said shaft and relative to said outer handle portion; and handle portion connector structure connecting said outer handle portion and said inner handle portion and preventing relative rotation therebetween whereby said inner handle portion will rotate with said outer handle portion, said shaft and said paper toweling support drum, said inner handle portion having at least one projection projecting therefrom and engageable with said at least one control switch responsive to rotation of said outer handle portion, said shaft and said paper toweling support drum.

2. The control apparatus according to claim 1 wherein said handle portion connector structure comprises a key and keyway interconnection between said inner and outer handle portions.

3. The control apparatus according to claim 1 including a plurality of control switches for controlling a plurality of functions of said paper towel dispenser, a plurality of projections projecting from the inner handle portion engageable with said control switches.

4. The control apparatus according to claim 3 wherein said projections are spaced from one another.

5. The control apparatus according to claim 4 wherein said projections are of arcuate configuration.

6. The control apparatus according to claim 1 additionally including a handle retainer fixed in position relative to said at least one control switch and defining a handle retainer interior accommodating said handle and allowing rotation of said handle.

7. The control apparatus according to claim 6 wherein said handle retainer includes retainer structure engageable with said inner handle portion to retain said inner handle portion in said handle retainer interior and limit axial movement of said inner handle portion relative to said outer handle portion and said shaft.

8. The control apparatus according to claim 6 wherein said at least one control switch is mounted on an electronic control board of said paper toweling dispenser and wherein said handle retainer is located adjacent to said control board.

9. The control apparatus according to claim 8 wherein said electronic control board defines an opening through which said shaft projects.

* * * * *